US005402722A

United States Patent [19]

Schneider et al.

[11] Patent Number: 5,402,722

[45] Date of Patent: Apr. 4, 1995

[54] CYLINDER SPINDLE TENSIONING ASSEMBLY

[75] Inventors: Georg Schneider, Würzburg; Wolfgang O. Reder, Veitschöchheim, both of Germany

[73] Assignee: Koenig & Bauer Aktiengesellschaft, Wurzburg, Germany

[21] Appl. No.: 171,173

[22] Filed: Dec. 22, 1993

[30] Foreign Application Priority Data

Dec. 24, 1992 [DE] Germany ..... 42 44 074.2
Aug. 5, 1993 [DE] Germany ..... 43 26 247.3

[51] Int. Cl.[6] ..... B41F 27/06; B41F 27/12

[52] U.S. Cl. ..... 101/415.1; 101/382.1; 101/383; 101/378

[58] Field of Search ..... 101/382.1, 383, 415.1, 101/378

[56] References Cited

U.S. PATENT DOCUMENTS

| | | | |
|---|---|---|---|
| 2,778,307 | 1/1957 | Heller | 101/415.1 |
| 3,276,365 | 10/1966 | Langer | 101/415.1 |
| 3,715,981 | 2/1973 | Huffman | 101/415.1 |
| 3,896,727 | 7/1975 | Ruckdeschel, Jr. | 101/415.1 |
| 4,183,299 | 1/1980 | Cappel | 101/415.1 |
| 4,476,783 | 10/1984 | Tsukasaki | 101/415.1 |
| 4,646,639 | 3/1987 | Gollinger et al. | 101/415.1 |
| 4,748,911 | 6/1988 | Kobler | 101/378 |
| 5,010,818 | 4/1991 | Wallschlaeger, Sr. | 101/415.1 |

FOREIGN PATENT DOCUMENTS

| | | |
|---|---|---|
| 388029 | 10/1921 | Germany . |
| 1253283 | 5/1968 | Germany . |
| 2720673 | 9/1979 | Germany . |
| 8101707 | 4/1981 | Germany . |
| 3443353 | 4/1992 | Germany . |
| 4127714 | 2/1993 | Germany . |
| 443415 | 2/1936 | United Kingdom . |
| 929065 | 6/1963 | United Kingdom . |
| 1228110 | 4/1971 | United Kingdom . |
| 2089475 | 6/1982 | United Kingdom . |
| 2104623 | 3/1983 | United Kingdom . |
| 2158546 | 11/1985 | United Kingdom . |

*Primary Examiner*—Edgar S. Burr
*Assistant Examiner*—Lynn D. Hendrickson
*Attorney, Agent, or Firm*—Jones, Tullar & Cooper

[57] ABSTRACT

A cylinder spindle is usable in a device for tensioning bodies on a printing cylinder. The cylinder spindle is divided into a plurality of cooperating spindle segments. These segments are able to be easily removed from the tensioning device through a space between the end of the cylinder and its typically associated bearer ring.

9 Claims, 4 Drawing Sheets

3
III
III
e
h
l
b
1
2
4
6
8
9
11
12
13
14
14.1
14.2
14.3
16
17
18
19
21
22
23
24
26
27
29
30
31
32
33
34
42
43
44
45
47
58
58,59
59
61

3

CYLINDER SPINDLE TENSIONING ASSEMBLY

FIELD OF THE INVENTION

The present invention is directed generally to a cylinder spindle. More particularly, the present invention is directed to a spindle which is usable to tension a sheet or covering on a cylinder. Most specifically, the present invention is directed to a tensioning spindle for a cylinder of a rotary printing press. The tensioning spindle is used as the tensioning drive for securing and tensioning a covering, such as a flexible printing plate or blanket that is supported by the peripheral surface of a rotatable cylinder in a rotary printing press. The tensioning spindle is comprised of a plurality of tensioning spindle segments, all of which are operable together as a unit when the tensioning spindle is in place, but which can be removed sequentially as spindle segments to facilitate spindle repair or replacement.

DESCRIPTION OF THE PRIOR ART

In the field of rotary printing, it is very conventional to apply a number of devices, such as flexible printing plates, blanket coverings and the like to the peripheral surface of a rotatable cylinder. It is also generally known that these devices placed on the surface of the cylinder must be held in place with a certain amount of tension to insure that the devices will stay in place and will not shift. Such shifting would have a detrimental effect on the quality of the product printed by the press.

One prior art apparatus that is usable to fix and tension a blanket or a printing plate on a cylinder of an offset rotary printing press is shown in German document No. 81 01 707 A1. In that assembly there is provided a tensioning spindle which is situated in a groove that extends parallel to the cylinder's axis of rotation. The tensioning spindle is rotatably driven in its groove by the use of worm gears and worm shafts which are positioned at the ends of the tensioning spindle.

In this prior art device, the tensioning spindle is one solid element which extends across the length of the cylinder. When it is necessary to remove the spindle for maintenance or cleaning, this can be done only with a significant amount of effort and disruption of the operation of the press assembly. When the device is mounted in the cylinder groove, there has to be effected a new adaptation for avoiding damaging of the printing plates and for assuring a round running of the plate cylinder. A further limitation of this prior art device is that the tensioning shaft is liable to distort during the tensioning process since it is driven only at one or the other of its ends. This shaft distortion is apt to result in inaccurate tensioning of the sheet-like devices which are secured on the peripheral surface of the plate cylinder.

It will thus be seen that a need exists for a tensioning assembly that overcomes the limitations of the prior art devices. The cylinder spindle in accordance with the present invention provides such a device and is a significant improvement over the prior art devices.

SUMMARY OF THE INVENTION

It is an object of the present invention to provide a tensioning spindle for a cylinder.

Another object of the present invention is to provide a cylinder spindle that is usable to tension a device on a cylinder.

A further object of the present invention is to provide a tensioning spindle for a cylinder of a rotary printing press.

Yet another object of the present invention is to provide a tensioning spindle comprised of a plurality of tensioning spindle segments.

Even still a further object of the present invention is to provide a cylinder tensioning spindle that is easily mounted and dismounted in a cylinder groove.

Yet even another object of the present invention is to provide a cylinder spindle that has an inside diameter which is smaller than an overall length of a spindle.

As will be discussed in detail in the description of the preferred embodiment which is set forth subsequently, the cylinder spindle in accordance with the present invention utilizes a plurality of tensioning spindle segments that are positioned together and rotatably secured in a groove on the peripheral surface of a rotary cylinder of a printing press. Each tensioning spindle segment is preferably provided with teeth around a portion of its periphery. These teeth are engaged by a plurality of axially spaced toothed racks which are all shiftable circumferentially in the cylinder groove. The use of a plurality of spindle segments and the rotation of the spindle segments as an operative assembly by the plurality of toothed racks provides several distinct advantages over the prior art devices.

The provision of a tensioning spindle which is separated in tensioning spindle portions means that these spindle portions or segments can be easily removed for cleaning and maintenance purposes by removal out through the interspace between the axial and of the tensioning device and bearer rings which are typically arranged at the end faces of the plate cylinder. In plate cylinders without bearer rings, the spindle portions or segments can also be removed out from an interspace between the end of the tensioning device and the side frame of the printing press. In this way, even in a cylinder with a width of more than 2,000 mm, the tensioning spindle, consisting of the several spindle portions can be dismounted without problems. After the spindle segments of the tensioning spindle have been removed, the insert bar can be removed out from the cylinder groove without much effort simply by loosening several screws. This is also the case for the exchange of the compressed air hose. The portions or segments of the tensioning spindle are driven synchronously by the toothed racks or rods, so that a straight-line tensioning of a sheet-shaped body with an even tensioning force is assured. The cylinder spindle in accordance with the present invention can be manufactured at a low cost while using only a few parts that can be made quite simply.

The cylinder spindle in accordance with the present invention overcomes the limitations of the prior art devices. It provides a tensioning spindle for a printing cylinder or the like which is a substantial advance in the art.

BRIEF DESCRIPTION OF THE DRAWINGS

While the novel features of the cylinder tensioning spindle in accordance with the present invention are set forth with particularity in the appended claims, a full and complete understanding of the invention may be had by referring to the detailed description of the preferred embodiment which is set forth subsequently, and as illustrated in the accompanying drawings, in which:

DESCRIPTION OF THE PREFERRED EMBODIMENT

Figure 1:
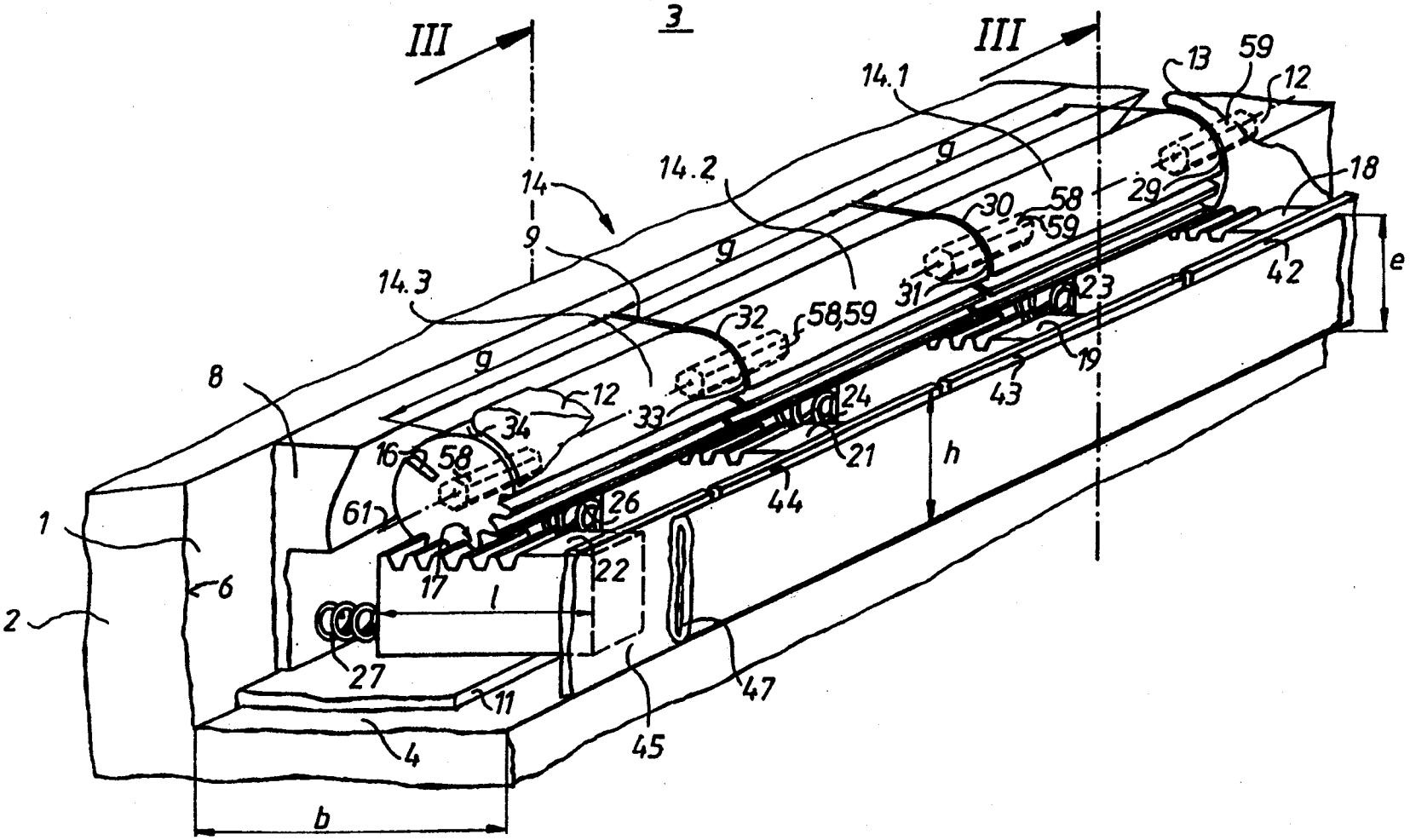
FIG. 1 is a perspective view of a cylinder tensioning spindle in accordance with the preferred embodiment with portions of the cylinder removed for clarity of illustration.

Referring initially primarily to FIG. 1, there may be seen a first preferred embodiment, generally at 3 of a device for tensioning flexible bodies in accordance with the present invention. The tensioning device 3 is received in an axially extending cylinder groove or channel 1 on the peripheral surface of a plate cylinder 2. The device for tensioning flexible bodies, generally at 3 is intended to be used to secure and tension various flexible printing plates, blanket coverings or the like on the peripheral surface of a generally conventional plate cylinder 2 in a rotary printing press. Since the plate cylinder 2 and the printing press of which it is a part, are generally conventional in nature, they will not be discussed in detail other than to the extent needed to provide a full and complete understanding of the operation of the subject invention.

As may be seen most clearly in FIGS. 1 and 3–6, the cylinder groove 1 has a plane bottom area 4 as well as two lateral side surfaces or walls 6 and 7 which define the bottom area 4. The tensioning device 3 is arranged in the cylinder groove 1 and extends in the groove parallel to the axis of rotation of plate cylinder 2. A first insert bar 8 extends along the first lateral wall surface 6 and has a first hang-up profile 9 which, as seen in FIGS. 3–6, is parallel to the axis of cylinder 2 and extends at an acute angle, for receiving an angled end of a printing plate, which is not shown The insert bar 8 rests on a lower, second end which is situated near to the bottom area 4 of the cylinder groove 1 on a base plate 11.

Figure 3:
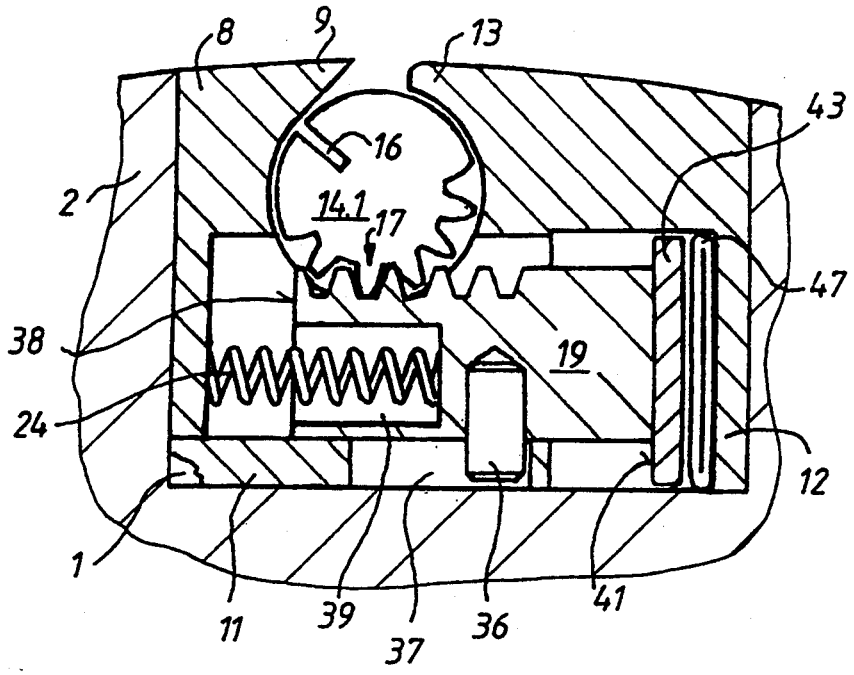
FIG. 3 is a cross-sectional view of a first preferred embodiment of the cylinder spindle taken along line III—III of FIG. 1 and showing the spindle in a tensioning position.
Figure 4:
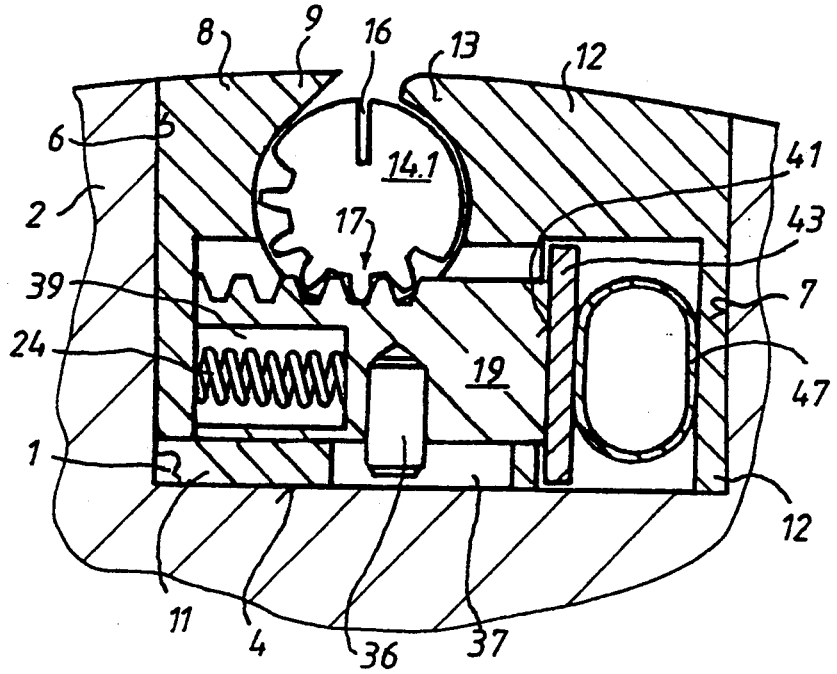
FIG. 4 is a view similar to FIG. 3 and showing the spindle in a plate hang-up or receiving position.

A second insert bar 12 extends along the second lateral surface or wall 7 and has an upper rounded hang-up edge 13, extending at an acute angle, and being parallel to the axis of cylinder 2, over which an end of a printing plate can be drawn with the plate end being then led to a tensioning spindle 14 in accordance with the present invention for tensioning a second printing plate end. The first insert bar 8 is executed as a onepart assembly as is the second insert bar 12, as can be seen in FIGS. 3 and 4. They define an axially extending hollow space for receiving the portions or segments 14.1 to 14.4 of tensioning spindle 14 and the toothed racks or rods 18 to 22 of the present invention. The insert bar 12 is shown in FIG. 1 only by its front sides.

The tensioning spindle 14 has an essentially circular cross section with a slot 16 for receiving a bent-over second end of a printing plate to be tensioned. Diametrically on the opposite side of the circumference of the tensioning spindle 14, as seen most clearly in FIG. 1, are provided teeth 17 with a width corresponding to the length g of the tensioning spindle 14 or to the portions or segments 14.1 to 14.4 of the tensioning spindle 14. The crown line of the teeth 17 will correspond to the diameter of the tensioning spindle 14. The tensioning spindle 14 is separated along its length into a plurality of spindle segments, such as into four such portions or segments 14.1, 14.2, 14.3 and 14.4. The portion of tensioning spindle 14.4 and its associated toothed rod or rack has not been shown in FIG. 1. The portions of tensioning spindle 14.1 to 14.4 engage with their lower or radially inner side provided with teeth 17 and directing to the base plate 11, the upperside of a plurality of rack teeth on toothed rods or racks 18, 19, 21, 22 which are usable to apply a tangential force to the spindle 14. The toothed rods or racks 18 to 22 each have a generally rectangular cross section and have a length 1 which is approximately 0.6 to 0.8 times the width b of the cylinder groove 1. These racks 18, 19, 21 and 22 are movable with their bottom area on the base plate 11 of the cylinder groove 1, against the force of biasing or preload springs 23, 24, 26, 27, in the circumferential direction of the plate cylinder 2. The toothed racks or rods 18 to 22 can also have a round cross section. Each of the toothed rods 18, 19, 21, 22 is arranged below an end 29, 30, 31, 32, 33, 34, of one or more of the portions or segments of tensioning spindle 14.1, 14.2, 14.3, 14.4, of tensioning spindle 14. A first end 29 of tensioning spindle segment 14.1 meshes in the toothed rod 18. A second end 30 of the tensioning spindle segment 14.1, as well as a first end 31 of the tensioning spindle segment 14.2 meshes in the toothed rod 19. The second end 32 of the tensioning spindle segment 14.2 as well as the first end 33 of the tensioning segment spindle 14.3 meshes in the toothed rod 21. The second end 34 of the tensioning spindle segment 14.3 as well as a not shown first end of the tensioning spindle segment 14.4 meshes in the toothed rod 22. The second, not shown end of tensioning spindle segment 14.4 meshes in a not shown toothed rod. The toothed rods 18, 19, 21, 22 each have at their underside a material-fit journal 36, with each of these journals meshing in a circular limited slot 37 in the base plate 11, as may be seen most clearly in FIGS. 3–7. This allows the toothed rods or racks 18, 19, 21 and 22 to be said circumferentially in the cylinder groove 1 across the base plate 11 while not allowing the toothed racks 18, 19, 21 and 22 to move axially in the cylinder groove. As may be seen most clearly in FIGS. 3–7 circumferential sliding movement of the toothed racks 18, 19, 21 and 22 causes rotary movement of the associated tensioning spindle segments 14.1, 14.2, 14.3 and 14.4 in the open space defined by the first and second insert bars 8 and 12 in the cylinder groove 1. Each of the slots 37 in which the journals 36 are guided are arranged parallel to each other in the cylinder groove 1 and are also parallel to the end faces of the plate cylinder 2. The plurality of biasing springs 27, which act to bias all of the toothed racks 18, 19, 21 and 22 in a first circumferential direction, can each be received in pocket bore holes 39 in first end faces 38 of the toothed rods or racks 18, 19, 21 and 22.

Again referring to FIGS. 1 and 3–7, a second end face 41 of each of the toothed rods or racks 18, 19, 21 and 22, which respectively face toward the second side wall or face 7 of the cylinder groove 1 are secured to cooperating abutment plates 42, 43, 44 or 45. These abutment plates 42–45 extend parallel to second side wall 7 of the cylinder groove 1. Suitable screws 49, as depicted schematically in FIG. 2 may be used to secure the abutment plates 42–45 to the second ends of the toothed racks 18, 19, 21 and 22. These several abutment plates 42–45 are spaced slightly from each other in the axial direction and each has a height h which, as may be seen most clearly in FIG. 1 is greater in the radial direction of the cylinder 2 than the stretched width e of an air hose 47.

As is depicted in FIGS. 1–4, the air hose 47 is positioned, as a one piece assembly, and extending in the axial direction of cylinder 2, between the abutment plates 42 to 45 and the second lateral surface 7 of the cylinder groove 1. The air hose 47 is closed at its first end and is provided at its second end with a connecting piece 48 to accomplish the inlet and the outlet of compressed air. The compressed air can be supplied with a pressure of 6 to 8 bar by a not shown hose and by a not shown valve from a compressed air source. The connecting piece 48 is situated at the first end of the tensioning device 3 and is connected during standstill of the plate cylinder 2 with the hose 47.

Figure 2:
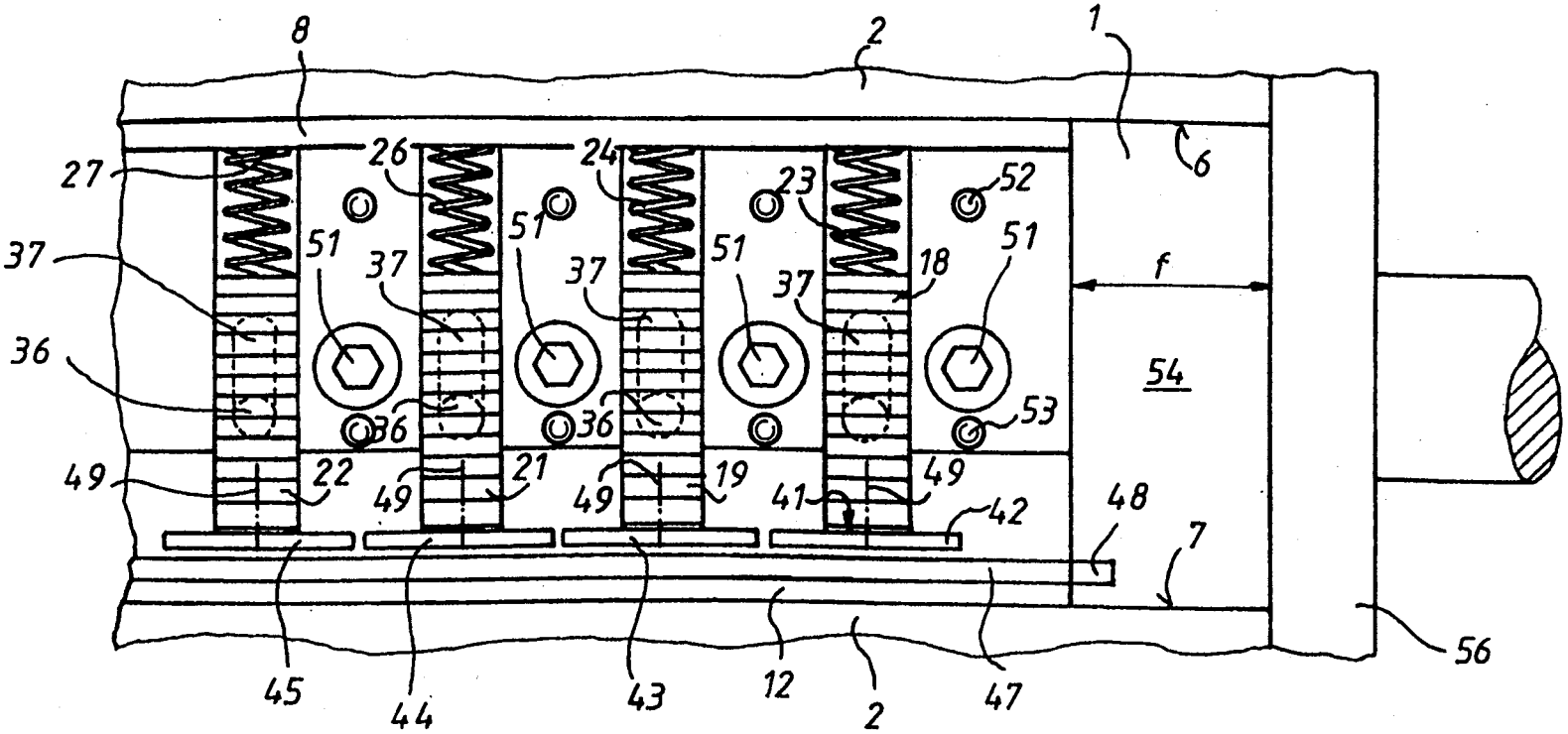
FIG. 2 is a schematic top plan view of a portion of the cylinder tensioning spindle apparatus and showing the toothed racks.

The tensioning device 3 is fixed in the cylinder groove 1 through holes in the base plate 11. For this purpose, there are provided screws 51, which cooperate with tap holes in the bottom area 4 of the cylinder groove 1. The base plate 11 is connected with the one-part executed insert bars 8 and 12 by means of screws 52 and 53, as seen in FIG. 2. The insert bars 8 and 12 are shaped on their side directing to the tensioning spindle 14, in such way, that there can be taken up between the insert bar 8 and the slot 16 of the tensioning spindle 14 the end of a printing plate.

In the operation of the device for tensioning flexible bodies 3 on a plate cylinder 2 in accordance with the present invention, the tensioning spindle 14 which consists of the tensioning spindle segments 14.1, 14.2, 14.3 and 14.4 are moved during a stoppage of the plate cylinder 2 from the tensioning position shown in FIG. 3 to the plate attachment or hanging on position which is depicted in FIG. 4. To shift the tensioning spindle 14 to the plate hanging position shown in FIG. 4, the connecting piece 48 of the air hose 47 is provided with compressed air, so that the hose 47 is inflated. The air hose 47 rests in this connection with its flank at the lower part of the insert bar 12, so that the abutment plates 42, 43, 44, 45 press the toothed racks or rods 18, 19, 21, 22 against the force of springs 23, 24, 26, 27 in the direction of the first insert bar 8. As a result of the meshing of the teeth 17 of the tensioning spindle segments 14.1, 14.2, 14.3, 14.4 in the teeth of the toothed racks or rods 18, 19, 21, 22, the tensioning spindle segments 14.1 to 14.4 are turned synchronously in such a way that the tensioning spindle segments 14.1, 14.2, 14.3, 14.4 act together as, and rotate as a single tensioning spindle 14. This is the case even when the air hose 47 is unevenly filled. For tensioning the tensioning spindle 14 to bring it to the position shown in FIGS. 1 or 3, the compressed air supply is interrupted, the compressed air is allowed to escape, and the springs 23, 24, 26, 27 bring the toothed racks or rods 18, 19, 21, 22 synchronously with the tensioning spindle segments 14.1, 14.2, 14.3, 14.4 again into the tensioning position.

When it is necessary to perform cleaning or repair work, the tensioning spindle segments 14.1, 14.2, 14.3, 14.4 can be removed out through an interspace 54 which is situated in the cylinder groove 1 between the end of the tensioning device 3 and a bearer ring 56. In this connection, a distance f between the bearer ring 56 and the adjacent of the tensioning device 3 in the cylinder groove 1 is greater than the length g of any one of the tensioning spindle segments 14.1, 14.2, 14.3, or 14.4 so that a quick removal of the tensioning spindle segments 14.1 to 14.4 is assured. In plate cylinders without bearer rings, there is required an interspace 54 between the end of the tensioning device 3 and a side frame for removing the individual tensioning spindle segments 14.1 to 14.4. Thus, it is not necessary to dismount the whole tensioning device 3 for cleaning and repairing work. In the direction of the axis of rotation 61 of the cylinder 2, there can be arranged even more than four tensioning spindle segments 14.1, 14.2, 14.3, 14.4 such as, for example, six or eight segments, according to the width of the plate cylinder.

Figure 5:
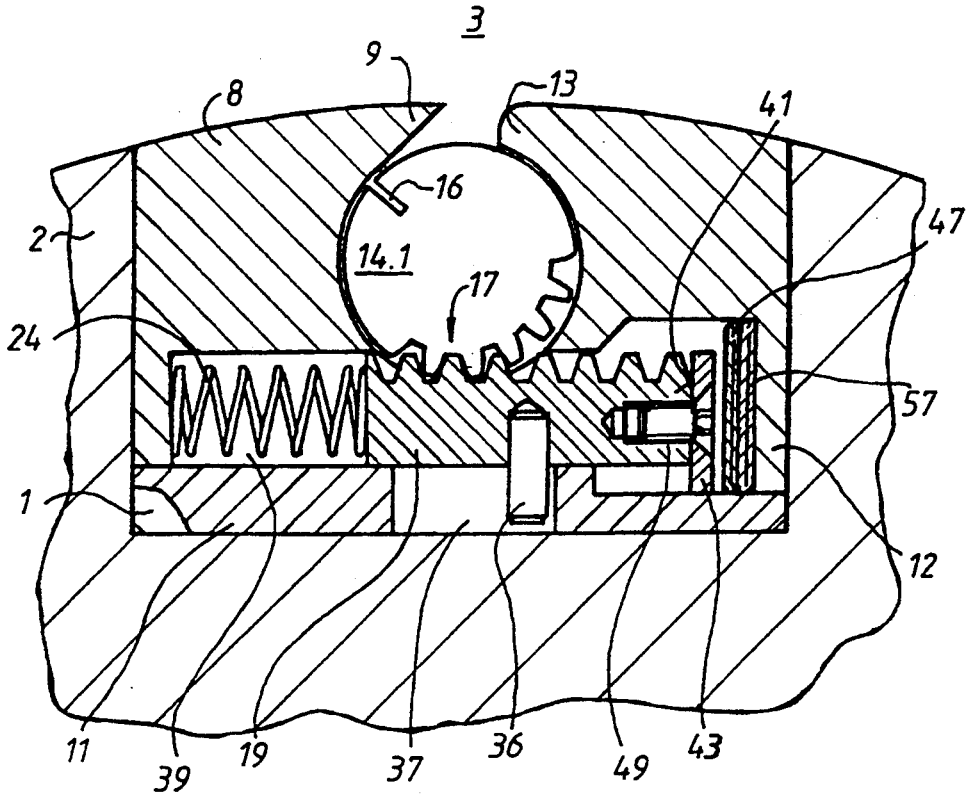
FIG. 5 is a cross-sectional view of a second preferred embodiment of a cylinder tensioning spindle in its tensioning position.
Figure 6:
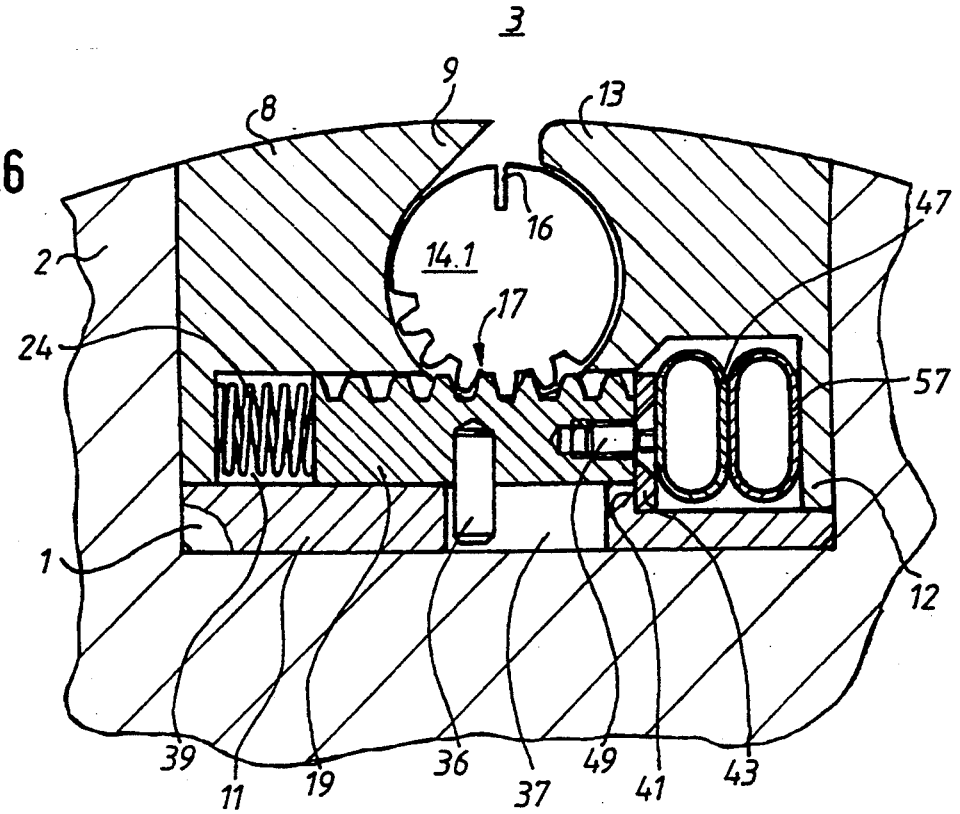
FIG. 6 is a view similar to FIG. 5 and showing the cylinder tensioning spindle in a plate hang-up or receiving position.

In a second preferred arrangement of the device for tensioning flexible bodies 3 in accordance with the present invention, as may be seen in FIGS. 5 and 6, there may be provided a second air hose 57 which is arranged parallel to the first air hose 47. This second air hose 57 can also be provided with compressed air through a connecting piece which is not specifically shown in the drawings but which will be understood as being similar to the connecting piece 48 for the first air hose 47. The parallel arrangement of the two air hoses 47 and 57 is used especially in cases where the plate cylinder 2 has a greater circumference or where the printing plate or other flexible device that is to be clamped on the plate cylinder 2 has a greater length.

In accordance with the present invention, it is also possible to replace the air hoses 47 and 57 with other adjustment elements. In such an arrangement, the toothed racks or rods 18, 19, 21, 22 could then have a greater number of teeth than the toothed rods 18, 19, 21, 22 which are described in the first embodiment, and could be actuated through the abutment plates 42 to 45 by means of, for example, the turning movement of a camshaft, arranged parallely to the axis of cylinder 2. A camshaft of this kind is shown in the German patent specification No. 12 53 283. Further, it would be possible to have a piston rod of a compressed air cylinder act against each one of the shiftable toothed racks or rods 18, 19, 21 or 22. The number of compressed air cylinders would correspond to the number of toothed racks or rods 18, 19, 21, and 22. The compressed air cylinders could be switched parallely and could be connected to an air supply in a manner analogous to the connecting piece 48. It would also be possible to form the front areas of the toothed racks or rods 18, 19, 21 and 22, carrying the abutment plates 42 to 45, in a wedge-shaped manner, against which a bar with supplementing wedge areas can be shifted in the axial direction. The throw-on movement could be effected by a piston rod of a compressed air cylinder, arranged in the interspace 54.

It is possible in accordance with the present invention to utilize the device for tensioning flexible bodies 3 to secure another flexible, sheet-shaped body, other than a printing plate, such as, for example a blanket, on a cylinder of a printing machine. In this connection, a first end of the blanket, which is provided with a reinforcement, is placed over the hang-up profile 9 of the insert bar 8 and hung with the reinforcement in a slot, extending parallely to the hang-up profile. The second end of the blanket is also provided with a reinforcement and is hung into the slot 16 of the tensioning spindle 14, while the spindle is in its position shown in FIGS. 4 and 6. The tensioning of the blanket is then effected by turning the tensioning spindle 14 to its position shown in FIGS. 3 and 5 by allowing the compressed air to escape out from the air hose 47, 57. The cylinder which is now provided with a blanket, can be used as an impression cylinder generally and specifically as an impression cylinder in satellite printing units used for job printing.

As has been discussed above, the tensioning spindle 14 in accordance with the present invention, can be removed from the space between the insert bars 8 and 12 in the cylinder groove 1 by moving the spindle 14 into the interspace 54 and by separation of the spindle into its individual spindle segments 14.1, 14.2, 14.3 and 14.4. In the preferred embodiment of the spindle 14 described above, the individual spindle segments 14.1, 14.2, 14.3 and 14.4 may not be connected directly to each other but instead can operate as a unit through their cooperating connection to the toothed racks 18, 19, 21 and 22. As discussed previously, the toothed racks, such as rack 19 engage adjacent ends of two spindle segments, such as ends 30 and 31 of spindle segments 14.1 and 14.2, and the air hose 47 or the air hoses 47 and 57 move all of the abutment plates 42, 43, 44 and 45 at the same time. Thus tensioning spindle 14 rotates as a single element even though the individual segments 14.1, 14.2, 14.3 and 14.4 may not be physically connected.

In a further embodiment of the tensioning spindle 14 of the device for tensioning flexible bodies 3 in accordance with the present invention, there can be provided, to connect the portions of tensioning spindle 14.1 to 14.4 force- and form-fit at their adjacent ends to each, non-switchable couplings, which are shown in FIG. 1 by broken lines, and which may, for example, consist of a hexagon cap screw 58, situated at the first end 31 of the portion of tensioning spindle 14.2, and which meshes force- and form-fit in an internal hexagon head screw 59, which is situated on the second end of the portion of tensioning spindle 14.1. In this way, the tensioning spindle segments 14.1 to 14.4 can be separably connected to each other. In this embodiment, the portions of tensioning spindle 14.1 to 14.4 have no teeth 17 at their circumference. Further, in this embodiment, the toothed rods 18, 19, 21, 22 are provided without teeth and serve as bearing surfaces for the tensioning spindle segments 14.1 to 14.4, which are provided with couplings. There can be provided plane teeth or a claw-coupling as a non-switchable coupling between respective tensioning spindle segments 14.1 to 14.4. The drive of the tensioning spindle segments 14.1 to 14.4 can be effected through an end of the tensioning spindle segment 14.1 by a drive that can be arranged within the interspace 54 shown in FIG. 2 and between the bearer ring 56 and the device 3. The drive can consist of, for example a worm wheel, connected form-fit with a lateral surface of the tensioning spindle 14.1, and which meshes with a drivable worm. The worm can be driven, for example by a hand crank drive or by an adjusting motor. Thus, the tensioning spindle 14 is driven around its axis of rotation 61. The tensioning spindle segments 14.1 to 14.4 can be easily removed separately out from the interspace 54 between the bearer ring 56 and the device 3.

In an alternative embodiment of the cylinder spindle in accordance with the present invention, the tensioning spindle 14 may be formed as a single element with a plurality of teeth 17 on its circumference and with these teeth meshing with the toothed racks or rods 18, 19, 21, and 22 which, as discussed previously, are movable by the air hoses 47 and 57 on the bottom area 4 of the cylinder groove 1 against the tensioning bias exerted by the several springs 23, 24, 26 and 27.

While a preferred embodiment of a cylinder spindle in accordance with the present invention has been set forth fully and completely hereinabove, it will be apparent that the spindle of the present invention can be used in any place where only a small mounting space is provided for such a spindle or a shaft. The application of the cylinder spindle is not restricted solely to printing machines. It will also be apparent to one of skill in the art that a number of changes in, for example the overall size of the cylinder, the overall length of the spindle, the compressed air supply and the like may be made without departing from the true spirit and scope of the present invention which is accordingly to be limited only by the following claims.

We claim:

1. A tensioning spindle assembly usable in a device for tensioning flexible bodies on a cylinder of a printing machine, said tensioning spindle assembly including a plurality of tensioning spindle segments arranged adjacent each other along an axial direction of said cylinder, each of said tensioning spindle segments having circumferentially arranged teeth at axial ends, and further including a plurality of shiftable toothed racks extending generally in a cross direction to said axial direction of said cylinder, each of said toothed racks having rack teeth in engagement with said teeth on said tensioning spindle segments, said rack teeth of at least one of said shiftable toothed racks engaging said teeth on two of said adjacent tensioning spindle segments, said tensioning spindle assembly further having an adjustment element and a plurality of axially spaced preload springs, each of said shiftable toothed racks being shiftable in said cross direction by said adjustment element against said preload springs.

2. The tensioning spindle of claim 1 wherein said adjustment element includes at least a first inflatable hose.

3. The tensioning spindle of claim 1 wherein said tensioning spindle segments are connected by couplings extending in said axial direction.

4. A tensioning device usable to tension flexible bodies on a cylinder of a printing machine, said tensioning device comprising:

a cylinder having a peripheral surface for support of a flexible body to be tensioned and having an axis of rotation;

a cylinder groove on said peripheral surface of said cylinder, said cylinder groove extending in a direction of said axis of rotation;

first and second spaced side walls in said cylinder groove;

a tensioning spindle positioned in said cylinder groove for rotation, said tensioning spindle including first and second end spindle segments and at least one intermediate spindle segment; and means for rotating said tensioning spindle in said cylinder groove.

5. The tensioning device in accordance with claim 4 further including a plurality of toothed racks having rack teeth and wherein each of said spindle segments has a plurality of circumferential teeth, said rack teeth being in engagement with said circumferential teeth.

6. The tensioning device of claim 5 wherein said plurality of toothed racks are axially spaced in said cylinder groove and are shiftable in a direction generally transverse to said cylinder axis of rotation.

7. The tensioning device of claim 6 wherein said means for rotating said tensioning spindle includes means to shift said plurality of toothed racks in said cylinder groove.

8. The tensioning device of claim 7 wherein said means to shift said toothed racks is at least a first inflatable hose positioned in said cylinder groove adjacent a first of said first and second side walls.

9. The tensioning device of claim 8 wherein each of said toothed racks is biased into engagement with said inflatable hose by a biasing spring interposed between an end of said toothed rack and a second of said first and second side walls.

* * * * *